US007575620B2

(12) United States Patent
Terry et al.

(10) Patent No.: US 7,575,620 B2
(45) Date of Patent: Aug. 18, 2009

(54) INFILTRANT MATRIX POWDER AND PRODUCT USING SUCH POWDER

(75) Inventors: Charles J. Terry, Fallon, NV (US); Kawika S. Fisher, Fallon, NV (US)

(73) Assignee: Kennametal Inc., Latrobe, PA (US)

( * ) Notice: Subject to any disclaimer, the term of this patent is extended or adjusted under 35 U.S.C. 154(b) by 288 days.

(21) Appl. No.: 11/446,802

(22) Filed: Jun. 5, 2006

(65) Prior Publication Data

US 2007/0277646 A1 Dec. 6, 2007

(51) Int. Cl.
*B22F 1/00* (2006.01)

(52) U.S. Cl. ..... 75/252

(58) Field of Classification Search ..... 74/240; 75/240, 242, 252

See application file for complete search history.

(56) References Cited

U.S. PATENT DOCUMENTS

| | | | |
|---|---|---|---|
| 3,379,503 | A | 4/1968 | McKenna |
| 4,834,963 | A | 5/1989 | Terry et al. |
| 4,837,417 | A | 6/1989 | Funk |
| 5,589,268 | A | 12/1996 | Kelley et al. |
| 5,662,183 | A | 9/1997 | Fang |
| 5,733,649 | A | 3/1998 | Kelley et al. |
| 5,733,664 | A | 3/1998 | Kelley et al. |
| 5,776,593 | A | 7/1998 | Massa et al. |
| 5,806,934 | A | 9/1998 | Massa et al. |
| 5,944,127 | A | 8/1999 | Liang et al. |
| 6,024,776 | A | 2/2000 | Heinrich et al. |
| 6,287,360 | B1 | 9/2001 | Kembaiyan et al. |
| 6,780,458 | B2 | 8/2004 | Seth et al. |
| 6,984,454 | B2 | 1/2006 | Majagi |

OTHER PUBLICATIONS

PCT/US07/12886 Written Opinion of the International Searching Authority mailed Nov. 21, 2007 (3 pages).
PCT/US07/12886 International Search Report mailed Nov. 21, 2007 (1 page).

*Primary Examiner*—Roy King
*Assistant Examiner*—Ngoclan T Mai
(74) *Attorney, Agent, or Firm*—Matthew W. Smith

(57) ABSTRACT

A matrix powder that includes (a) about 15 weight percent of −325 Mesh cast tungsten carbide particles; (b) about 2 weight percent −325 Mesh particles comprising one or more of iron particles and nickel particles; (c) about 2 weight percent +60 Mesh macrocrystalline tungsten carbide particles; (d) about 6 weight percent −60+80 Mesh macrocrystalline tungsten carbide particles; and (e) about 75 weight percent −80+325 Mesh hard particles. A portion of component (e) forms between about 10 weight percent and about 20 weight percent of the matrix powder. The portion of component (e) that is crushed cemented tungsten carbide particles containing one or more of cobalt and nickel within one of the following particle size ranges: (i) −80+120 Mesh hard particles; (ii) −120+170 Mesh hard particles; (iii) −170+230 Mesh hard particles; (iv) −230+325 Mesh hard particles; (v) −325 Mesh hard particles. The balance of component (e) is macrocrystalline tungsten carbide particles.

21 Claims, 2 Drawing Sheets

INFILTRANT MATRIX POWDER AND PRODUCT USING SUCH POWDER

BACKGROUND OF THE INVENTION

The present invention relates to a metal matrix powder for use along with an infiltrant to form a metal matrix. More particularly, the invention pertains to a metal matrix powder for use along with an infiltrant to form a metal matrix wherein the metal matrix exhibits improved abrasion resistance properties and/or improved strength properties.

Heretofore, a hard composite has been formed by positioning one or more hard elements (or members) within a metal matrix powder, and then infiltrating the metal powder matrix with an infiltrant metal to form the metal matrix with the hard elements held therein. This hard composite can be useful as a cutter or a wear member. More particularly, the hard composite can be a diamond composite that comprises a metal matrix (i.e., metal matrix powder infiltrated and bonded together by an infiltrant metal) with one or more discrete diamond-based elements held therein. These diamond-based elements could comprise a discrete-diamond composite or polycrystalline diamond composite having a substrate with a layer of polycrystalline diamond thereon. The following patents pertain to an infiltrant matrix powder: U.S. Pat. No. 5,589,268 to Kelley et al., U.S. Pat. No. 5,733,649 to Kelley et al., U.S. Pat. No. 5,733,664 to Kelley et al., and each one of these patents is assigned to Kennametal Inc., Typical metal matrix powders have included macrocrystalline tungsten carbide as a significant component. Macrocrystalline tungsten carbide is essentially stoichiometric WC which is, for the most part, in the form of single crystals. Some large crystals of macrocrystalline tungsten carbide are bicrystals. U.S. Pat. No. 3,379,503 to McKenna for a PROCESS FOR PREPARING TUNGSTEN MONOCARBIDE, assigned to the assignee of the present patent application, discloses a method of making macrocrystalline tungsten carbide. U.S. Pat. No. 4,834,963 to Terry et al. for MACROCRYSTALLINE TUNGSTEN MONOCARBIDE POWDER AND PROCESS FOR PRODUCING, assigned to the assignee of the present patent application, also discloses a method of making macrocrystalline tungsten carbide.

Metal matrix powders have also included crushed cemented tungsten carbide. This material comprises small particles of tungsten carbide bonded together in a metal matrix. As one example, the crushed cemented macrocrystalline tungsten carbide with a binder (cobalt) is made by mixing together WC particles, Co powder and a lubricant. This mixture is pelletized, sintered, cooled, and then crushed. The pelletization does not use pressure, but instead, during the mixing of the WC particles and cobalt, the blades of the mixer cause the mixture of WC and cobalt to ball up into pellets.

Metal matrix powders have also used crushed cast tungsten carbide. Crushed cast tungsten carbide forms two carbides; namely, WC and $W_2C$. There can be a continuous range of compositions therebetween. An eutectic mixture is about 4.5 weight percent carbon. Cast tungsten carbide commercially used as a matrix powder typically has a hypoeutectic carbon content of about 4 weight percent. Cast tungsten carbide is typically frozen from the molten state and comminuted to the desired particle size.

While these earlier metal matrices for a hard composite have performed in a satisfactory fashion, it would be desirable to provide an improved matrix for a hard composite having improved properties. These properties include impact strength, transverse rupture strength, hardness, abrasion resistance, and erosion resistance. It would also be desirable to provide an improved hard composite that uses the improved matrix material

SUMMARY OF THE INVENTION

In one form, the invention is a matrix powder that comprises (a) about 15 weight percent of −325 Mesh cast tungsten carbide particles, (b) about 2 weight percent −325 Mesh particles comprising one or more of iron particles and nickel particles, (c) about 2 weight percent +60 Mesh macrocrystalline tungsten carbide particles, (d) about 6 weight percent −60+80 Mesh macrocrystalline tungsten carbide particles, and (e) about 75 weight percent −80+325 Mesh hard particles comprised of crushed cemented tungsten carbide particles that contain one or more of cobalt and nickel. The crushed cemented tungsten carbide particles are within at least one of the following particle size ranges: (i) −80+120 Mesh hard particles, (ii) −120+170 Mesh hard particles, (iii) −170+230 Mesh hard particles, (iv) −230+325 Mesh hard particles, and (v) −325 Mesh hard particles. The crushed cemented tungsten carbide particles constitute between about 10 weight percent to about 20 weight percent of the matrix powder and the balance of (e) is comprised of macrocrystalline tungsten carbide particles.

In yet another form thereof, the invention is a matrix powder that comprises (a) about 15 weight percent of −325 Mesh cast tungsten carbide particles, (b) about 2 weight percent −325 Mesh particles comprising one or more of iron particles and nickel particles, (c) about 2 weight percent +60 Mesh macrocrystalline tungsten carbide particles, (d) about 6 weight percent −60+80 Mesh macrocrystalline tungsten carbide particles, and (e) about 75 weight percent −80+325 Mesh hard particles comprised of crushed cemented tungsten carbide particles that contain one or more of cobalt and nickel. The crushed cemented tungsten carbide particles are within at least two of the following particle size ranges: (i) −80+120 Mesh hard particles, (ii) −120+170 Mesh hard particles, (iii) −170+230 Mesh hard particles, (iv) −230+325 Mesh hard particles, (v) −325 Mesh hard particles. The crushed cemented tungsten carbide particles constitute between about 25 weight percent to about 35 weight percent of the matrix powder and the balance of (e) is comprised of macrocrystalline tungsten carbide particles.

In still another form thereof, the invention is a matrix powder that comprises (a) about 15 weight percent of −325 Mesh cast tungsten carbide particles, (b) about 2 weight percent −325 Mesh particles comprising one or more of iron particles and nickel particles, (c) about 2 weight percent +60 Mesh macrocrystalline tungsten carbide particles, (d) about 6 weight percent −60+80 Mesh macrocrystalline tungsten carbide particles, and (e) about 75 weight percent −80+325 Mesh hard particles that are comprised of crushed cemented tungsten carbide particles. The crushed cemented tungsten carbide particles are within at least three of the following particle size ranges: (i) −80+120 Mesh hard particles, (ii) −120+170 Mesh hard particles, (iii) −170+230 Mesh hard particles, (iv) −230+325 Mesh hard particles, and (v) −325 Mesh hard particles. The crushed cemented tungsten carbide particles constitute between about 35 weight percent to about 50 weight percent of the matrix powder and the balance of (e) is comprised of macrocrystalline tungsten carbide particles.

BRIEF DESCRIPTION OF THE DRAWINGS

The following is a brief description of the drawings which form a part of this patent application.

DETAILED DESCRIPTION OF SPECIFIC EMBODIMENTS

Figure 1:
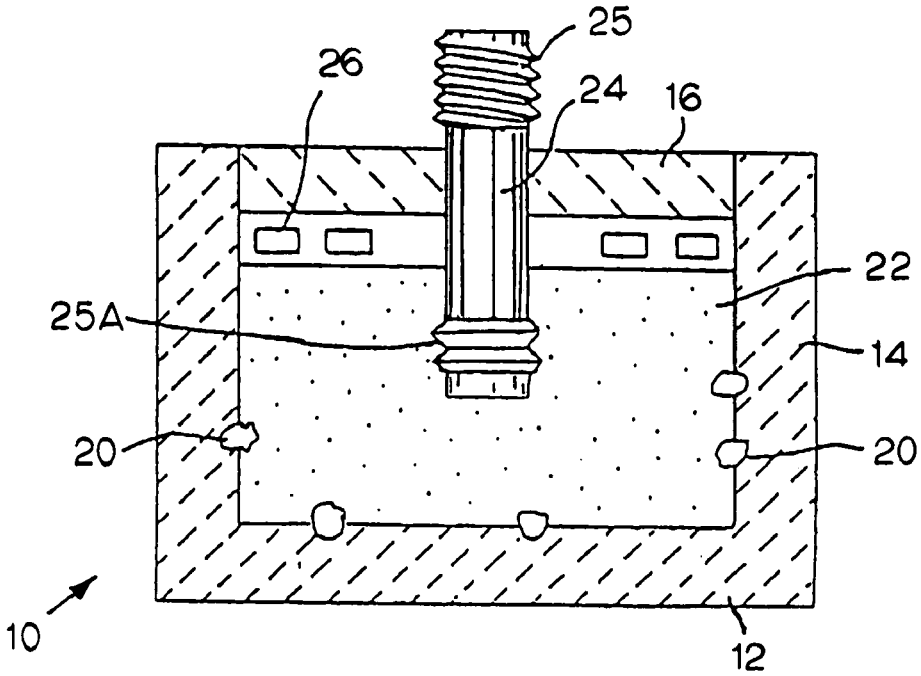
FIG. 1 is a schematic view of the assembly used to make a product comprising a tool shank with one embodiment of the discrete diamonds bonded thereto.

Referring to FIG. 1, there is illustrated a schematic of the assembly used to manufacture a product using the diamond as part of the present invention. The typical product is a drill head. As will become apparent, the drill head has a shank. Cutter elements, such as the discrete diamonds are bonded to the bit head with the metal matrix. Although the method by which the shank is affixed to the drill line may vary, one common method is to provide threads on the shank so that the shank threadedly engages a threaded bore in the drill line. Another way is to weld the shank to the drill line. The production assembly includes a carbon mold, generally designated as 10, having a bottom wall 12 and an upstanding wall 14. The mold 10 defines a volume therein. The assembly further includes a top member 16 which fits over the opening of the mold 10. It should be understood that the use of the top number 16 is optional depending upon the degree of atmospheric control one desires.

A steel shank 24 is positioned within the mold before the powder is poured therein. A portion of the steel shank 24 is within the powder mixture 22 and another portion of the steel shank 24 is outside of the mixture 22. Shank 24 has threads 25 at one end thereof, and grooves 25A at the other end thereof.

Referring to the contents of the mold, there are a plurality of discrete diamonds 20 positioned at selected positions within the mold so as to be at selected positions on the surface of the finished product. The matrix powder 22 is a carbide-based powder which is poured into the mold 10 so as to be on top of the diamonds 20. The composition of the matrix powder 22 will be set forth hereinafter.

Once the diamonds 20 have been set and the matrix powder 22 poured into the mold, infiltrant alloy 26 is positioned on top of the powder mixture 22 in the mold 10. Then the top 16 is positioned over the mold, and the mold is placed into a furnace and heated to approximately 2200° F. so that the infiltrant 26 melts and infiltrates the powder mass. The result is an end product wherein the infiltrant bonds the powder together, the matrix holds the diamonds therein, and the composite is bonded to the steel shank.

Figure 2:
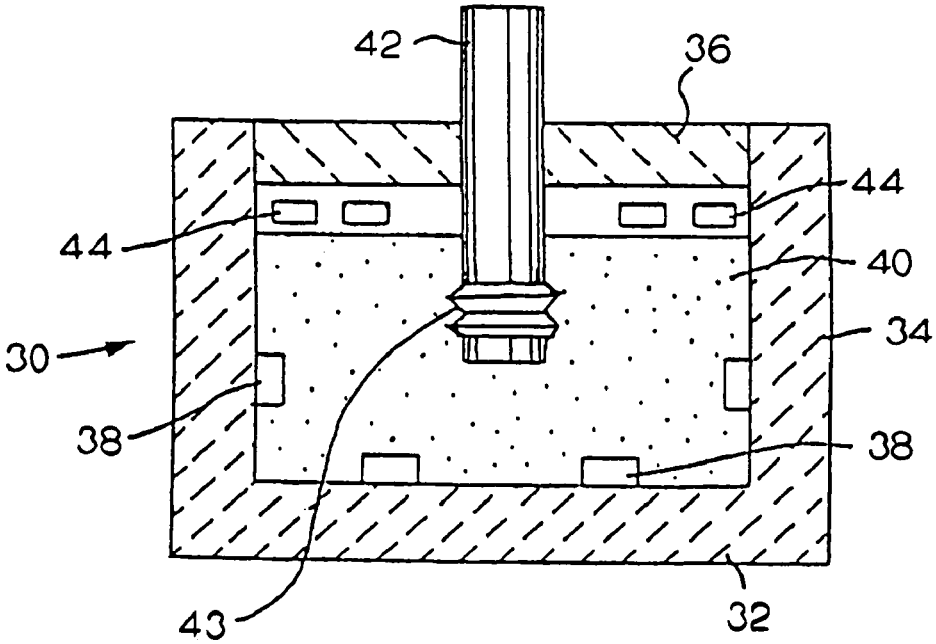
FIG. 2 is a schematic view of the assembly used to make a product comprising a tool shank with another embodiment of the diamond composite bonded thereto.

Referring to FIG. 2, there is illustrated a schematic of the assembly used to manufacture a second type of product using the diamond composites as part of the present invention. The assembly includes a carbon mold, generally designated as 30, having a bottom wall 32 and an upstanding wall 34. The mold 30 defines a volume therein. The assembly further includes a top member 36 which fits over the opening of the mold 30. It should be understood that the use of the top member 36 is optional depending upon the degree of atmospheric control one desires.

A steel shank 42 is positioned within the mold before the powder mixture is poured therein. A portion of the steel shank 42 is within the powder mixture 40 and another portion of the steel shank 42 is outside of the mixture. The shank 42 has grooves 43 at the end that is within the powder mixture.

Referring to the contents of the mold 30, there are a plurality of carbon blanks 38 positioned at selected positions within the mold so as to be at selected positions on the surface of the finished product. The matrix powder 40 is a carbide-based powder which is poured into the mold 30 so as to be on top of the carbon blanks 38. The composition of the matrix powder 40 will be set forth hereinafter.

Once the carbon blanks 38 have been set and the matrix powder 40 poured into the mold 30, infiltrant alloy 44 is positioned on top of the powder mixture in the mold. Then the top 36 is positioned over the mold, and the mold is placed into a furnace and heated to approximately 2200° F. so that the infiltrant melts and infiltrates the powder mass. The result is an intermediate product wherein the infiltrant bonds the powder together, also bonding the powder mass to the steel shank, and the carbon blanks define recesses in the surface of the infiltrated mass.

The carbon blanks are removed from bonded mass and a diamond composite insert, having a shape like that of the carbon blank, is brazed into the recess to form the end product. Typically, the diamond composite drill head has a layer of discrete diamonds along the side.

Figure 3:
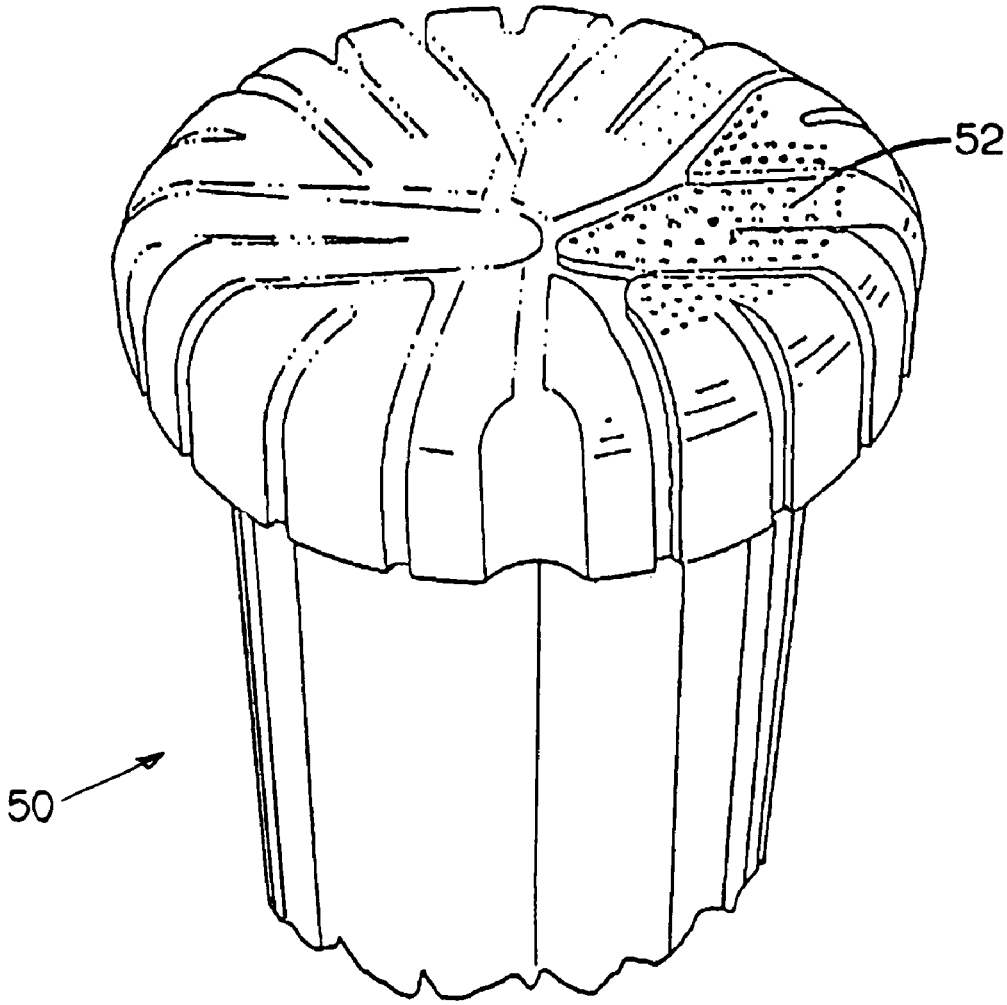
FIG. 3 is a perspective view of a tool drill bit that incorporates the present invention

Referring to FIG. 3, there is illustrated therein a portion of a tool, generally designated as 50. The tool 50 has a forwardly facing surface to which are bonded discrete diamond elements 52.

The following tests were conducted to determine the performance of the inventive compositions as compared to a prior art composition, and in particular, to Prior Art Composition A. In all of the examples set forth below, the mesh size of the components of the metal matrix powder was determined according to ASTM Standard E-11-04, Standard Specification for Wire Cloth and Sieves for Testing Purposes.

For all of the specific examples, the infiltrant that was used to form the metal matrix was MACROFIL 53. The nominal composition of the MACROFIL 53 was 53.0 weight percent copper, 24.0 weight percent manganese, 15.0 weight percent nickel, and 8.0 weight percent zinc. The working temperature was equal to 1177 degrees Centigrade. The solidus temperature was equal to 952 degrees Centigrade, and the liquidus temperature was equal to 1061 degrees Centigrade. This infiltrant is sold by Belmont Metals Inc., 330 Belmont Avenue, Brooklyn, N.Y. 11207, under the name designation "VIRGIN binder 4537D" in 1 inch by ½ inch by ½ inch chunks. This alloy is identified as MACROFIL 53 by applicants' assignee (Kennametal Inc. of Latrobe, Pa. 15650), and this designation will be used in this application. Another suitable infiltrant is MACROFIL 65, which has the following nominal composition: 65 weight percent copper, 15 weight percent nickel, and 20 weight percent zinc. The working temperature was equal to 1177 degrees Centigrade. The solidus temperature was equal to 1040 degrees Centigrade, and the liquidus temperature was equal to 1075 degrees Centigrade. The MACROFIL 65 infiltrant is available through commercial sources that are easily accessible to one skilled in the art.

To form the metal matrix used in the examples herein, the powder mixture was placed in a mold along with MACROFIL 53 infiltrant, and heated at about 2200° F. until the infiltrant had adequately infiltrated the powder mass so as to bond it together. The mass was then allowed to cool. This mass was the body that was tested for abrasion resistance and for strength.

In order to evaluate the properties of the specific metal matrices of the specific examples, applicants performed testing of these specific examples to ascertain the wear resistance properties and the strength properties. The test results presented herein are in the form of a wear resistance index and a strength index. In order to develop these indices, the wear resistance and the strength of the Prior Art Composition A (see Table A below) were ascertained and this value was defined as 100 percent. The wear resistance and the strength of each one the metal matrices of Inventive Examples Nos. 1-11 was measured and then reported herein as a percentage of the wear resistance and strength, respectively, of Prior Art Composition A.

In reference to the testing for wear resistance, two tests were performed to arrive at the wear resistance index. The first test was designed to be along the lines of the Riley-Stoker method (ASTM B611 Standard) and the second test was a slurry erosion test similar to ASTM G76-05 Standard, but using water instead of gas. The test specimens were coins of the metal matrix to be subjected to the test. The test results for the Riley-Stoker method and the test results of the G76-05 slurry erosion test were averaged to arrive at the wear resistance index. The wear resistance testing was the same for the prior art, as well as the inventive examples.

In reference to the testing for the strength, two tests were performed to arrive at the strength index. The first test was designed to be along the general lines of a notched charpy impact test wherein the testing was done along the general lines of ASTM E23-05 or ASTM A370-05 Standard, and the second test was along the ASTM B406-76 Standard to ascertain transverse rupture strength. The test results for the charpy impact test and the test results for the transverse rupture strength test were averaged to arrive at the strength index. The strength testing was the same for the prior art, as well as for the inventive examples.

The prior art commercial matrix powder was designated as Prior Art Composition A. Table A sets forth the composition of the Prior Art Composition A powder.

TABLE A

Composition and Properties of Prior Art Composition A

| Prior Art Composition A Component | Particle Size | Content in Weight Percent |
|---|---|---|
| Cast tungsten carbide | −325 Mesh | 15% |
| Fine nickel INCO type 123 from International Nickel Company and is a singular spike covered regular shaped powder | −325 Mesh | 2% |
| Macrocrystalline tungsten carbide | +60 Mesh | 2% |
| Macrocrystalline tungsten carbide | −60 + 80 Mesh | 6% |
| Macrocrystalline tungsten carbide | −80 + 120 Mesh | 15% |
| Macrocrystalline tungsten carbide | −120 + 170 Mesh | 15% |
| Macrocrystalline tungsten carbide | −170 + 230 Mesh | 15% |
| Macrocrystalline tungsten carbide | −230 + 325 Mesh | 15% |
| Macrocrystalline tungsten carbide | −325 Mesh | 15% |

Tables 1 through 11 set out the test results for inventive Examples 1 through 11. Each table presents the components, the particle size ranges for each component, and the content in weight percent for each component.

The composition including the particle size distribution of Example No. 1 is set forth below in Table 1. The abrasion resistance test results showed that the abrasion resistance of Example No. 1 was 122 percent of the abrasion resistance of the Prior Art Composition A material. The strength test results showed that the strength of Example No. 1 was 100 percent of the strength of the Prior Art Composition A material. As can be seen from a comparison of the Prior Art Composition A material and Example No. 1, the microcrystalline tungsten carbide in the −325 Mesh particle size distribution was replaced with −325 Mesh sintered cobalt (6 weight percent) cemented tungsten carbides. It should be F appreciated that even though the above specific substitution used a sintered cobalt cemented tungsten carbide particles that contained 6 weight percent cobalt, applicants contemplate that the sintered cobalt cemented tungsten carbide particles may contain between about 4 weight percent and about 10 weight percent cobalt.

TABLE 1

Composition and Properties of Inventive Example No. 1

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Macrocrystalline tungsten carbide | −80 + 120 Mesh | 15% |
| Macrocrystalline tungsten carbide | −120 + 170 Mesh | 15% |
| Macrocrystalline tungsten carbide | −170 + 230 Mesh | 15% |
| Macrocrystalline tungsten carbide | −230 + 325 Mesh | 15% |
| Sintered cobalt cemented tungsten carbides (6 weight percent cobalt) | −325 Mesh | 15% |

The composition including the particle size distribution of Example No. 2 is set forth below in Table 2. The abrasion resistance test results showed that the abrasion resistance of Example No. 2 was 118 percent of the abrasion resistance of the Prior Art Composition A material. The strength test results showed that the strength of Example No. 2 was 104 percent of the strength of the Prior Art Composition A material.

TABLE 2

Composition and Properties of Inventive Example No. 2

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Macrocrystalline tungsten carbide | −80 + 120 Mesh | 15% |
| Macrocrystalline tungsten carbide | −120 + 170 Mesh | 15% |
| Macrocrystalline tungsten carbide | −170 + 230 Mesh | 15% |
| Sintered cobalt cemented tungsten carbides (6 weight percent cobalt) | −230 + 325 Mesh | 15% |
| Macrocrystalline tungsten carbide | −325 Mesh | 15% |

As can be seen from a comparison of the Prior Art Composition A material and Example No. 2, the macrocrystalline tungsten carbide in the −230+325 Mesh particle size distribution was replaced with −230+325 Mesh sintered cobalt cemented tungsten carbide (6 weight percent) particles.

The composition including the particle size distribution of Example No. 3 is set forth below in Table 3. The abrasion resistance test results showed that the abrasion resistance of Example No. 3 was 116 percent of the abrasion resistance of the Prior Art Composition A material. The strength test results showed that the strength of Example No. 3 was 108 percent of the strength of the Prior Art Composition A material.

TABLE 3

Composition and Properties of Inventive Example No. 3

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Macrocrystalline tungsten carbide | −80 + 120 Mesh | 15% |
| Macrocrystalline tungsten carbide | −120 + 170 Mesh | 15% |
| Sintered cobalt cemented tungsten carbides (6 weight percent cobalt) | −170 + 230 Mesh | 15% |
| Macrocrystalline tungsten carbide | −230 + 325 Mesh | 15% |
| Macrocrystalline tungsten carbide | −325 Mesh | 15% |

As can be seen from a comparison of the Prior Art Composition A material and Example No. 3, the macrocrystalline tungsten carbide in the −170+230 Mesh particle size distribution was replaced with −170+230 Mesh sintered cobalt cemented tungsten carbide (6 weight percent) particles.

The composition including the particle size distribution of Example No. 4 is set forth below in Table 4. The abrasion resistance test results showed that the abrasion resistance of Example No. 4 was 121 percent of the abrasion resistance of the Prior Art Composition A material. The strength test results showed that the strength of Example No. 4 was 114 percent of the strength of the Prior Art Composition A material.

TABLE 4

Composition and Properties of Inventive Example No. 4

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Macrocrystalline tungsten carbide | −80 + 120 Mesh | 15% |
| Sintered cobalt cemented tungsten carbide (6 weight percent cobalt) | −120 + 170 Mesh | 15% |
| Macrocrystalline tungsten carbide | −170 + 230 Mesh | 15% |
| Macrocrystalline tungsten carbide | −230 + 325 Mesh | 15% |
| Macrocrystalline tungsten carbide | −325 Mesh | 15% |

As can be seen from a comparison of the Prior Art Composition A material and Example No. 4, the macrocrystalline tungsten carbide in the −120+170 Mesh particle size distribution was replaced with −120+170 Mesh sintered cobalt cemented tungsten carbide (6 weight percent) particles.

The composition including the particle size distribution of Example No. 5 is set forth below in Table 5. The abrasion resistance test results showed that the abrasion resistance of Example No. 5 was 122 percent of the abrasion resistance of the Prior Art Composition A material. The strength test results showed that the strength of Example No. 5 was 124 percent of the strength of the Prior Art Composition A material.

TABLE 5

Composition and Properties of Inventive Example No. 5

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Sintered cobalt cemented tungsten carbide (6 weight percent cobalt) | −80 + 120 Mesh | 15% |
| Macrocrystalline tungsten carbide | −120 + 170 Mesh | 15% |
| Macrocrystalline tungsten carbide | −170 + 230 Mesh | 15% |
| Macrocrystalline tungsten carbide | −230 + 325 Mesh | 15% |
| Macrocrystalline tungsten carbide | −325 Mesh | 15% |

As can be seen from a comparison of the Prior Art Composition A material and Example No. 5, the macrocrystalline tungsten carbide in the −80+120 Mesh particle size distribution was replaced with −80+120 Mesh sintered cobalt cemented tungsten carbide (6 weight percent) particles.

The composition including the particle size distribution of Example No. 6 is set forth below in Table 6. The abrasion resistance test results showed that the abrasion resistance of Example No. 6 was 134 percent of the abrasion resistance of the Prior Art Composition A material. The strength test results showed that the strength of Example No. 6 was 113 percent of the strength of the Prior Art Composition A material.

TABLE 6

Composition and Properties of Inventive Example No. 6

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Sintered cobalt cemented tungsten carbides (6 weight percent cobalt) | −80 + 120 Mesh | 15% |
| Macrocrystalline tungsten carbide | −120 + 170 Mesh | 15% |
| Macrocrystalline tungsten carbide | −170 + 230 Mesh | 15% |
| Macrocrystalline tungsten carbide | −230 + 325 Mesh | 15% |
| Sintered cobalt cemented tungsten carbides (6 weight percent cobalt) | −325 Mesh | 15% |

As can be seen from a comparison of the Prior Art Composition A material and Example No. 6, the macrocrystalline tungsten carbide in the −80+120 Mesh particle size distribution and in the −325 Mesh particle size distribution were replaced with sintered cobalt cemented tungsten carbide (6 weight percent) particles in the same particle size distributions.

The composition including the particle size distribution of Example No. 7 is set forth below in Table 7. The abrasion resistance test results showed that the abrasion resistance of Example No. 7 was 141 percent of the abrasion resistance of the Prior Art Composition A material. The strength test results showed that the strength of Example No. 7 was 117 percent of the strength of the Prior Art Composition A material.

TABLE 7

Composition and Properties of Inventive Example No. 7

| Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Sintered cobalt cemented tungsten carbide (6 weight percent cobalt) | −80 + 120 Mesh | 15% |
| Macrocrystalline tungsten carbide | −120 + 170 Mesh | 15% |
| Macrocrystalline tungsten carbide | −170 + 230 Mesh | 15% |
| Sintered cobalt cemented tungsten carbides (6 weight percent cobalt) | −230 + 325 Mesh | 15% |
| Macrocrystalline tungsten carbide | −325 Mesh | 15% |

As can be seen from a comparison of the Prior Art Composition A material and Example No. 7, the macrocrystalline tungsten carbide in the −80+120 Mesh particle size distribution and the −230+325 Mesh particle size distribution were replaced with sintered cobalt cemented tungsten carbide (6 weight percent) particles in the same particle size distributions.

The composition including the particle size distribution of Example No. 8 is set forth below in Table 8. The abrasion resistance test results showed that the abrasion resistance of Example No. 8 was 135 percent of the abrasion resistance of the Prior Art Composition A material. The strength test results showed that the strength of Example No. 8 was 118 percent of the strength of the Prior Art Composition A material.

TABLE 8

Composition and Properties of Inventive Example No. 8

| HDK Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Sintered cobalt cemented tungsten carbide (6 weight percent cobalt) | −80 + 120 Mesh | 15% |

TABLE 8-continued

Composition and Properties of Inventive Example No. 8

| HDK Component | Particle Size | Content in Weight Percent |
|---|---|---|
| Macrocrystalline tungsten carbide | −120 + 170 Mesh | 15% |
| Sintered cobalt cemented tungsten carbide (6 weight percent cobalt) | −170 + 230 Mesh | 15% |
| Macrocrystalline tungsten carbide | −230 + 325 Mesh | 15% |
| Macrocrystalline tungsten carbide | −325 Mesh | 15% |

As can be seen from a comparison of the Prior Art Composition A material and Example No. 8, the macrocrystalline tungsten carbide in the −80+120 Mesh particle size distribution and the −170+230 Mesh particle size distribution were replaced with sintered cobalt cemented tungsten carbide (6 weight percent) particles in the same particle size distributions.

The composition including the particle size distribution of Example No. 9 is set forth below in Table 9. The abrasion resistance test results showed that the abrasion resistance of Example No. 9 was 140 percent of the abrasion resistance of the Prior Art Composition A material. The strength test results showed that the strength of Example No. 9 was 128 percent of the strength of the Prior Art Composition A material.

TABLE 9

Composition and Properties of Inventive Example No. 9

| HDK Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Sintered cobalt cemented tungsten carbide (6 weight percent cobalt) | −80 + 120 Mesh | 15% |
| Sintered cobalt cemented tungsten carbide (6 weight percent cobalt) | −120 + 170 Mesh | 15% |
| Macrocrystalline tungsten carbide | −170 + 230 Mesh | 15% |
| Macrocrystalline tungsten carbide | −230 + 325 Mesh | 15% |
| Macrocrystalline tungsten carbide | −325 Mesh | 15% |

As can be seen from a comparison of the Prior Art Composition A material and Example No. 9, the macrocrystalline tungsten carbide in the −80+120 Mesh particle size distribution and the −120+170 Mesh particle size distribution were replaced with sintered cobalt cemented tungsten carbide (6 weight percent) particles in the same particle size distributions.

The composition including the particle size distribution of Example No. 10 is set forth below in Table 10. The abrasion resistance test results showed that the abrasion resistance of Example No. 10 was 144 percent of the abrasion resistance of the Prior Art Composition A material. The strength test results showed that the strength of Example No. 10 was 123 percent of the strength of the Prior Art Composition A material.

TABLE 10

Composition and Properties of Inventive Example No. 10

| HDK Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Crushed sintered cobalt (6 weight percent cobalt) tungsten carbide particles | −80 + 120 Mesh | 15% |
| Crushed sintered cobalt (6 weight percent cobalt) tungsten carbide particles | −120 + 170 Mesh | 15% |
| Macrocrystalline tungsten carbide | −170 + 230 Mesh | 15% |
| Macrocrystalline tungsten carbide | −230 + 325 Mesh | 15% |
| Macrocrystalline tungsten carbide | −325 Mesh | 15% |

As can be seen from a comparison of the Prior Art Composition A material and Example No. 10, the macrocrystalline tungsten carbide in the −80+120 Mesh particle size distribution and in the −120+170 Mesh particle size distribution were replaced with crushed sintered cobalt (6 weight percent cobalt) tungsten carbide particles in the −80+170 Mesh particle size distributions.

The composition including the particle size distribution of Example No. 11 is set forth below in Table 11. The abrasion resistance test results showed that the abrasion resistance of Example No. 11 was 144 percent of the abrasion resistance of the Prior Art Composition A material. The strength test results showed that the strength of Example No. 11 was 112 percent of the strength of the Prior Art Composition A material.

TABLE 11

Composition and Properties of Inventive Example No. 11

| HDK Component | Particle Size | Content in Weight Percent |
|---|---|---|
| Cast tungsten carbide | −325 Mesh | 15% |
| Fine nickel | −325 Mesh | 2% |
| Macrocrystalline tungsten carbide | +60 Mesh | 2% |
| Macrocrystalline tungsten carbide | −60 + 80 Mesh | 6% |
| Macrocrystalline tungsten carbide | −80 + 120 Mesh | 15% |
| Macrocrystalline tungsten carbide | −120 + 170 Mesh | 15% |
| Crushed sintered cobalt (6 weight percent cobalt) tungsten carbide particles | −170 + 230 Mesh | 15% |
| Crushed sintered cobalt (6 weight percent cobalt) tungsten carbide particles | −230 + 325 Mesh | 15% |
| Crushed sintered cobalt (6 weight percent cobalt) tungsten carbide particles | −325 Mesh | 15% |

As can be seen from a comparison of the Prior Art Composition A material and Example No. 11, the macrocrystalline tungsten carbide in the −170+325 Mesh particle size distribution (i.e., the combination of the −170+230 Mesh and the −230+326 Mesh and the −325 Mesh particle size distributions) was replaced with −170+325 Mesh crushed sintered cobalt (6 weight percent cobalt) tungsten carbide particles.

In looking at the overall results, it becomes apparent that the materials of the present invention provide increases in both abrasion resistance and strength as compared to the commercial Prior Art Composition A material. A more detailed discussion of these advantages now follows.

It can be seen that because of the substitution of crushed cemented tungsten carbides in the composition, both the wear resistance and the strength of the material experienced an increase as compared to the Prior Art Composition A material. In some cases, only one macrocrystalline tungsten carbide component was replaced with the crushed cemented (cobalt) tungsten carbide. In other cases, more than one macrocrystalline tungsten carbide component was replaced or substituted with the crushed cemented (cobalt) tungsten carbide particles.

Table 12 below compares the results of those compositions in which only one macrocrystalline tungsten carbide component was substituted with crushed cemented (cobalt) tungsten carbide particles. In Table 12, the substitution/weight percent refers to the particle size range (and how much) of the macrocrystalline tungsten carbide particles that was replaced with the crushed cemented (cobalt) tungsten carbide particles. The abrasion resistance is reported in an increase relative to the abrasion resistance of the Prior Art Composition A, and the strength is reported in an increase relative to the strength of the Prior Art Composition A material. More specifically, the abrasion resistance number was determined by performing a Riley-Stoker test and a slurry erosion test, which were normalized relative to the Prior Art Composition A and the normalized numbers averaged. The strength was determined by performing a transverse rupture strength test and an impact toughness test, which were normalized relative to the Prior Art Composition A and the normalized numbers averaged.

TABLE 12

Comparison of Compositions in which Only One Macrocrystalline Tungsten Carbide Component was Substituted with Crushed cemented (Cobalt) Tungsten Carbide Particles

| Example | Substitution/Weight Percent | Abrasion Resistance | Strength |
|---|---|---|---|
| 1 | −325 Mesh (15%) | 122% | 100% |
| 2 | −230 + 325 Mesh (15%) | 118% | 104% |
| 3 | −170 + 230 Mesh (15%) | 116% | 108% |
| 4 | −120 + 170 Mesh (15%) | 121% | 114% |
| 5 | −80 + 120 Mesh (15%) | 122% | 124% |

It becomes apparent from looking at Examples 1 and 2, that even when the smaller sized macrocrystalline tungsten carbide components are replaced by crushed cemented (cobalt) tungsten carbide particles, there is an increase (i.e., 118-122%) in the abrasion resistance as compared to the Prior Art Composition A material and an increase (up to 104%) in the strength as compared to the Prior Art Composition A material. It is also apparent from looking at the test results for Examples 3 through 5, that substitutions in the medium to larger sizes of particle size ranges provides for significant increases in both the abrasion resistance and strength (e.g., impact toughness). For Examples 3 through 5, the abrasion resistance ranges between 116% and 122% of the abrasion resistance of the Prior Art Composition A material, and the strength ranges between 108% to 124% of the strength of the Prior Art Composition A material.

It should also be noted that there is a general trend that as the particle size for the substituted particle size ranges increases so does the abrasion resistance and the strength. For example, in Example 1, which is a substitution in the −325 Mesh particle size range, the abrasion resistance is equal to 122% of the abrasion resistance of the Prior Art Composition A material and the strength is equal to 100% of the strength of the Prior Art Composition A material. In Example 5, which is a substitution in the −80+120 Mesh particle size range, the abrasion resistance is equal to 122% of the abrasion resistance of the Prior Art Composition A material and the strength is equal to 124% of the strength of the Prior Art Composition A material.

While the results that were obtained with the substitution of a single macrocrystalline tungsten carbide component with crushed cemented (cobalt) tungsten carbide particles were beneficial, applicant found that multiple substitutions, i.e., substitution of multiple particle size ranges of macrocrystalline tungsten carbide with crushed cemented (cobalt) tungsten carbide particles, produced greater benefits, i.e., a larger increase in properties. Table 13 is set forth below.

Table 13 presents a comparison of the results for the examples in which there were two substitutions. Like for Table 12, in Table 13 the substitution/weight percent refers to the particle size range (and how much) of the macrocrystalline tungsten carbide particles that was replaced with the crushed cemented (cobalt) tungsten carbide particles. The abrasion resistance is reported in an increase relative to the abrasion resistance of the Prior Art Composition A, and the strength is reported in an increase relative to the strength of the Prior Art Composition A material.

exhibited the greatest overall increase in the combined properties (i.e., a 122% increase in abrasion resistance and a 124% increase in strength).

The substitution of multiple (in this case two) particle size ranges resulted in even better overall improvement due to increases in abrasion resistance and consistent increases in strength. Along the same general line as the single substitution results, it appears that substitutions in the larger particle size ranges resulted in better results. In this regard, Example 9, which had the largest particle size range substitutions, experienced the best overall results with an abrasion resistance equal to 140% of the abrasion resistance of the Prior Art Composition A material and a strength equal to 128% of the strength of the Prior Art Composition A material.

The same trend associated with the multiple substitution of the macrocrystalline tungsten carbide particles with the crushed cemented (cobalt) tungsten carbide particles also existed for a different crushed cemented (cobalt) tungsten carbide particles (crushed sintered cobalt (6 weight percent cobalt) tungsten carbide particles). More specifically, in Example 10 crushed cemented (cobalt) tungsten carbide particles (crushed sintered cobalt (6 weight percent cobalt) tungsten carbide particles) replaced the macrocrystalline tungsten carbide in the −80+120 Mesh particle size range (15 weight percent) and in the −210+170 Mesh particle size range (15 weight percent). The test results were along the lines of Example 9 in that the abrasion resistance was equal to 144% of the abrasion resistance of the Prior Art Composition A material and the strength was equal to 123% of the strength of the Prior Art Composition A material.

TABLE 13

Comparison of Compositions in which Multiple Macrocrystalline Tungsten Carbide Components were Substituted with crushed cemented (cobalt) tungsten carbide particles

| Example | Substitution No. 1/Weight Percent | Substitution No. 2/ Weight Percent | Abrasion Resistance | Strength |
|---|---|---|---|---|
| 6 | −80 + 120 Mesh (15%) | −325 Mesh (15%) | 134% | 113% |
| 7 | −80 + 120 Mesh (15%) | −230 + 325 Mesh (15%) | 141% | 117% |
| 8 | −80 + 120 Mesh (15%) | −170 + 230 Mesh (15%) | 135% | 118% |
| 9 | −80 + 120 Mesh (15%) | −120 + 170 Mesh (15%) | 140% | 128% |

A review of the test results for Examples 6 through 9 shows that multiple substitutions (in these cases two substitutions) result in an increase in the abrasion resistance relative to the abrasion resistance of the Prior Art Composition A material. The multiple substitutions also result in an increase in the strength as compared to the strength of the Prior Art Composition A material. The largest combined increase in abrasion resistance and strength occurred in Example 9 in which the substitution occurred in adjacent particle size ranges (i.e., −170+230 Mesh and −120+170 Mesh) that were larger particle size ranges. For the material of Example 9, the abrasion resistance was 140% of the abrasion resistance of the Prior Art Composition A material, and the strength was 128% of the strength of the Prior Art Composition A material.

With respect to the substitution of macrocrystalline tungsten carbide by crushed cemented (cobalt) tungsten carbide particles, even single substitution in the smaller particle size ranges resulted in an improvement of the abrasion resistance, but not as much improvement in the strength. The material experienced a greater improvement in the combined properties of abrasion resistance and strength as the substituted particle sizes increased in size. For example, Example 5 had the largest particle size distribution (−80+120 Mesh) and Example 11 comprised a triple substitution in which macrocrystalline tungsten carbide particles in the following size ranges were replaced with crushed cemented (cobalt) tungsten carbide particles (crushed sintered cobalt (6 weight percent cobalt) tungsten carbide particles): −170+230 Mesh (15 weight percent) and −230+325 Mesh (15 weight percent) and −325 Mesh (15 weight percent). In Example 11, the abrasion resistance was equal to 144% of the abrasion resistance of the Prior Art Composition A material and the strength was equal to 112% of the strength of the Prior Art Composition A material. These substitutions occurred in the smaller to medium sizes of particle size ranges (e.g., −170+230 Mesh and −230+325 Mesh) as compared to larger particle size ranges (e.g., −80+120 Mesh or −120+170 Mesh). The results of Example 11 appear to be consistent with the overall results that occur when the substitutions include the larger sized particle size range.

It should be appreciated that the crushed cemented tungsten carbide particles may include a binder other than or in addition to cobalt. In this regard, the binder could be any one or more of cobalt or nickel.

It is apparent that applicant has invented a new and useful infiltrant matrix powder that exhibits an improvement in abrasion resistance and strength as compared to a commercially available infiltrant matrix powder. These improvements in abrasion resistance and strength provide for improved performance when used in various applications.

All patents, patent applications, articles and other documents identified herein are hereby incorporated by reference herein. Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A matrix powder comprising:

(a) about 15 weight percent of −325 Mesh cast tungsten carbide particles;

(b) about 2 weight percent −325 Mesh particles comprising one or more of iron particles and nickel particles;

(c) about 2 weight percent +60 Mesh macrocrystalline tungsten carbide particles;

(d) about 6 weight percent −60+80 Mesh macrocrystalline tungsten carbide particles; and (e) about 75 weight percent −80+325 Mesh hard particles comprised of crushed cemented tungsten carbide particles containing one or more of cobalt and nickel within at least one of the following particle size ranges:

(i) −80+120 Mesh hard particles;

(ii) −120+170 Mesh hard particles;

(iii) −170+230 Mesh hard particles;

(iv) −230+325 Mesh hard particles;

(v) −325 Mesh hard particles; and wherein said crushed cemented tungsten carbide particles constitute between about 10 weight percent to about 50 weight percent of the matrix powder and the balance of (e) is comprised of macrocrystalline tungsten carbide particles.

2. The matrix powder of claim 1 wherein the macrocrystalline tungsten carbide particles are within the particle size range −80+325 excluding the particle size range of the crushed cobalt cemented tungsten carbide particles.

3. The matrix powder of claim 1 wherein the crushed cemented tungsten carbide particle portion of component (e) are within particle size range (i).

4. The matrix powder of claim 1 wherein the crushed cemented tungsten carbide particle portion of component (e) are within particle size range (ii).

5. The matrix powder of claim 1 wherein the crushed cemented tungsten carbide particle portion of component (e) are within particle size range (iii).

6. The matrix powder of claim 1 wherein the crushed cemented tungsten carbide particle portion of component (e) are within particle size range (iv).

7. The matrix powder of claim 1 wherein the crushed cemented tungsten carbide particle portion of component (e) are within particle size range (v).

8. The matrix powder of claim 1 wherein the crushed cemented tungsten carbide particles of component (e) are comprised of between about 4 weight percent to about 10 weight percent cobalt or nickel.

9. The matrix powder of claim 1 wherein the crushed cemented tungsten carbide particles of component (e) are comprised of about 6 weight percent cobalt or nickel.

10. A matrix powder comprising:

(a) about 15 weight percent of −325 Mesh cast tungsten carbide particles;

(b) about 2 weight percent −325 Mesh particles comprising one or more of iron particles and nickel particles;

(c) about 2 weight percent +60 Mesh macrocrystalline tungsten carbide particles;

(d) about 6 weight percent −60+80 Mesh macrocrystalline tungsten carbide particles; and (e) about 75 weight percent −80+325 Mesh hard particles comprised of crushed cemented tungsten carbide particles containing one or more of cobalt and nickel within at least two of the following particle size ranges:

(i) −80+120 Mesh hard particles;

(ii) −120+170 Mesh hard particles;

(iii) −170+230 Mesh hard particles;

(iv) −230+325 Mesh hard particles;

(v) −325 Mesh hard particles; and wherein said crushed cemented tungsten carbide particles constitute between about 25 weight percent to about 35 weight percent of the matrix powder and the balance of (e) is comprised of macrocrystalline tungsten carbide particles.

11. The matrix powder of claim 10 wherein the macrocrystalline tungsten carbide particles are within the particle size range −80+325 excluding the particle size range of the crushed cobalt cemented tungsten carbide particles.

12. The matrix powder of claim 10 wherein the crushed cemented tungsten carbide particle portion of component (e) is comprised of:

−80+120 Mesh crushed cemented tungsten carbide particles comprising between about 10 weight percent and about 20 weight percent of the powder matrix; and −325 Mesh crushed cemented tungsten carbide particles comprising between about 10 weight percent and about 20 weight percent of the powder matrix.

13. The matrix powder of claim 10 wherein the crushed cemented tungsten carbide particle portion of component (e) is comprised of:

−80+120 Mesh crushed cemented tungsten carbide particles comprising between about 10 weight percent and about 20 weight percent of the powder matrix; and −230+325 Mesh crushed cemented tungsten carbide particles comprising between about 10 weight percent and about 20 weight percent of the powder matrix.

14. The matrix powder of claim 10 wherein the crushed cemented tungsten carbide particle portion of component (e) is comprised of:

−80+120 Mesh crushed cemented tungsten carbide particles comprising between about 10 weight percent and about 20 weight percent of the powder matrix; and −170+230 Mesh crushed cemented tungsten carbide particles comprising between about 10 weight percent and about 20 weight percent of the powder matrix.

15. The matrix powder of claim 10 wherein the crushed cemented tungsten carbide particle portion of component (e) is comprised of:

−80+120 Mesh crushed cemented tungsten carbide particles comprising between about 10 weight percent and about 20 weight percent of the powder matrix; and −120+170 Mesh crushed cemented tungsten carbide particles comprising between about 10 weight percent and about 20 weight percent of the powder matrix.

16. The matrix powder of claim 10 wherein the crushed cemented tungsten carbide particles of component (e) are comprised of between about 4 weight percent to about 10 weight percent cobalt or nickel.

17. The matrix powder of claim 10 wherein the crushed cemented tungsten carbide particles of component (e) are comprised of about 6 weight percent cobalt or nickel.

18. A matrix powder comprising:

(a) about 15 weight percent of −325 Mesh cast tungsten carbide particles;

(b) about 2 weight percent −325 Mesh particles comprising one or more of iron particles and nickel particles;

(c) about 2 weight percent +60 Mesh macrocrystalline tungsten carbide particles;

(d) about 6 weight percent −60+80 Mesh macrocrystalline tungsten carbide particles; and (e) about 75 weight percent −80+325 Mesh hard particles comprised of crushed cemented tungsten carbide particles within at least three of the following particle size ranges:

(i) −80+120 Mesh hard particles;

(ii) −120+170 Mesh hard particles;

(iii) −170+230 Mesh hard particles;

(iv) −230+325 Mesh hard particles;

(v) −325 Mesh hard particles; and wherein said crushed cemented tungsten carbide particles constitute between about 35 weight percent to about 50 weight percent of the matrix powder and the balance of (e) is comprised of macrocrystalline tungsten carbide particles.

19. The matrix powder of claim 18 wherein the crushed cemented tungsten carbide particles of component (e) are comprised of:

−170+230 Mesh crushed cemented tungsten carbide particles comprising between about 10 weight percent and about 20 weight percent of the powder matrix;

−230+325 Mesh crushed cemented tungsten carbide particles comprising between about 10 weight percent and about 20 weight percent of the powder matrix; and +325 Mesh crushed cemented tungsten carbide particles comprising between about 10 weight percent and about 20 weight percent of the powder matrix.

20. The matrix powder of claim 18 wherein the crushed cemented tungsten carbide particles of component (e) are comprised of between about 4 weight percent and about 10 weight percent cobalt or nickel.

21. The matrix powder of claim 18 wherein the crushed cemented tungsten carbide particles of component (e) are comprised of about 6 weight percent cobalt or nickel.

* * * * *